United States Patent [19]

Boldrini et al.

[11] Patent Number: 5,029,834

[45] Date of Patent: Jul. 9, 1991

[54] CONTINUOUS BLANK FEED METHOD AND DEVICE

[75] Inventors: Fulvio Boldrini, Ferrara; Antonio Gamberini, Bologna, both of Italy

[73] Assignee: G.D Società per Azioni, Bologna, Italy

[21] Appl. No.: 466,481

[22] Filed: Jan. 17, 1990

[30] Foreign Application Priority Data

Jan. 24, 1989 [IT] Italy ..... 3318 A/89

[51] Int. Cl.[5] ..... B65H 5/08

[52] U.S. Cl. ..... 271/11; 271/91; 271/95; 271/99; 271/96; 400/624; 101/409

[58] Field of Search ..... 271/5, 11, 91, 93, 95, 271/99, 102, 108, 12, 96, 94, 97, 98; 400/627; 101/137, 142, 409, 410

[56] References Cited

U.S. PATENT DOCUMENTS

| | | | |
|---|---|---|---|
| 1,810,171 | 6/1931 | Hallstream | 271/96 |
| 1,961,401 | 6/1934 | Steinmann | 271/11 |
| 2,827,287 | 3/1954 | Gross et al. | 271/11 |
| 3,394,930 | 7/1968 | Guggisberg | 271/11 |
| 3,545,740 | 12/1970 | Rana et al. | 271/12 X |
| 4,358,100 | 9/1980 | Müller | 271/11 |
| 4,491,311 | 1/1985 | Clanzman | 271/11 |
| 4,786,046 | 11/1988 | Freeman et al. | 271/195 X |
| 4,830,352 | 3/1989 | Birtwhistle | 271/11 X |

FOREIGN PATENT DOCUMENTS

| | | |
|---|---|---|
| 0207778 | 1/1987 | European Pat. Off. . |
| 0763916 | of 0000 | United Kingdom . |
| 2196327 | 4/1988 | United Kingdom . |

*Primary Examiner*—H. Grant Skaggs
*Assistant Examiner*—C. Druzbick
*Attorney, Agent, or Firm*—Marshall, O'Toole, Gerstein, Murray & Bicknell

[57] ABSTRACT

A method and device for continuously feeding blanks for the formation of hard cigarette packs, whereby the blanks are withdrawn successively from the bottom opening of a feedbox and fed on to the outer periphery of a conveyor roller by means of mobile suction heads guided cyclically by crank mechanisms along a route having a portion substantially perpendicular to the bottom opening of the feedbox, and a further portion substantially tangent to the periphery of the conveyor roller and which further route portion is followed by the suction heads at a speed substantially equal to the surface speed of the conveyor roller itself.

9 Claims, 6 Drawing Sheets

CONTINUOUS BLANK FEED METHOD AND DEVICE

BACKGROUND OF THE INVENTION

The present invention relates to a method of continuously feeding blanks, particularly for the formation of hard packs on a cigarette packing machine, said method comprising stages consisting in successively withdrawing the blanks from the bottom opening of a feedbox, and in feeding the same on to the outer periphery of a conveyor roller via a suction head designed to move between a withdrawal position contacting the blank at said opening, and an unloading position wherein the blank is transferred on to the periphery of said conveyor roller.

Blanks are generally fed between said feedbox and a jog-feed conveyor roller using a suction head which is moved between said withdrawal and unloading positions by means of a lever, which transfers the blanks along a trajectory substantially in the form of an arc of a circle into respective pockets formed on the conveyor roller.

Generally speaking, and particularly at the relatively high operating speeds demanded of modern packing machines, transfer of the blanks between the feeedbox and conveyor roller using the above method involves a number of major drawbacks, such as incorrect folding of the blanks as they are withdrawn from the feedbox, and poor stability of the same on the conveyor roller, due to the inertia caused by intermittent operation of the same.

SUMMARY OF THE INVENTION

The aim of the present invention is to provide a method of transferring blanks from a feedbox on to a conveyor roller, which method involves none of the drawbacks typically associated with known methods of the aforementioned type.

With this aim in view, according to the present invention, there is provided a method of continuously feeding blanks, particularly for the formation of hard packs on a cigarette packing machine, said method comprising stages consisting in successively withdrawing said blanks from the bottowm opening of a feedbox , and in feeding the same on to the outer periphery of a conveyor roller using at least a suction head designed to move between a withdrawal position contacting said blank at said opening, and an unloading position wherein said blanks are transferred on to the periphery of said conveyor roller; characterizing by the fact that said conveyor roller is turned about its axis at constant surface speed; and that said suction head is guided cyclically between said two positions by means of a crank mechanism which moves said suction head along a route having one portion substantially perpendicular to said opening, and a further portion substantially tangent to the periphery of said conveyor roller and which further route portion is followed by said suction head at a speed substantially equal to said surface speed.

The present invention also relates to a continuous blank feed device.

According to the present invention, there is provided a device for continuously feeding blanks, particularly for the formation of hard packs on a cigarette packing machine, said device comprising a feedbox for said blanks having a bottom opening; a conveyor roller; and at least a suction head for successively transferring said blanks from a withdrawal position at said opening to an unloading position on the periphery of said conveyor roller; characterizing by the fact that it also comprises means for turning said conveyor roller about its axis at constant surface speed; and a crank mechanism for guiding said suction head cyclically between said two positions and along a route having a portion substantially perpendicular to said opening, and a further portion substantially tangent to the periphery of said conveyor roller, and wherein said further route portion is followed by said suction head at a speed substantially equal to said surface speed.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
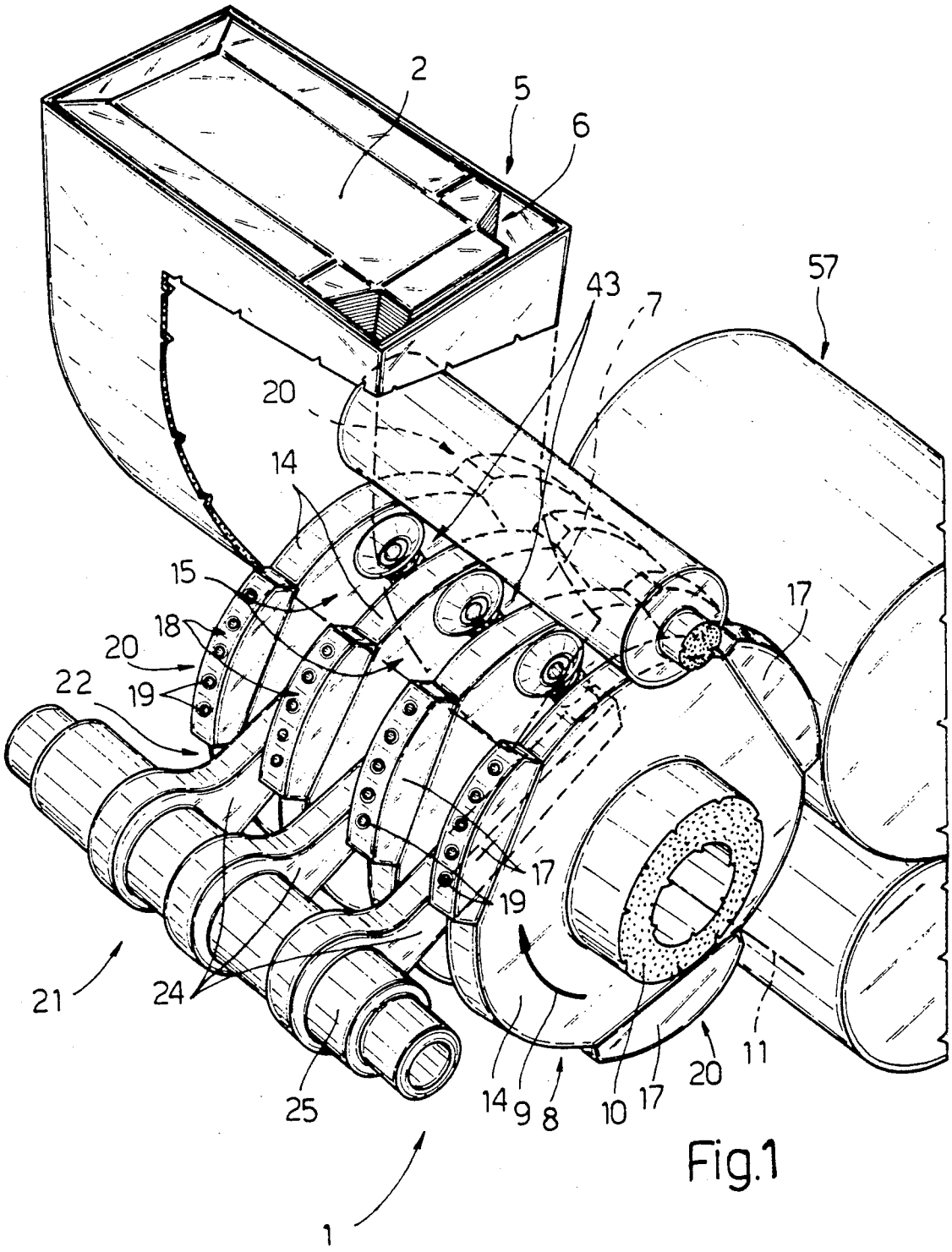
FIG. 1 shows a schematic view in perspective, with parts removed for simplicity, of a preferred embodiment of the blank feed device according to the present invention.
Figure 2:
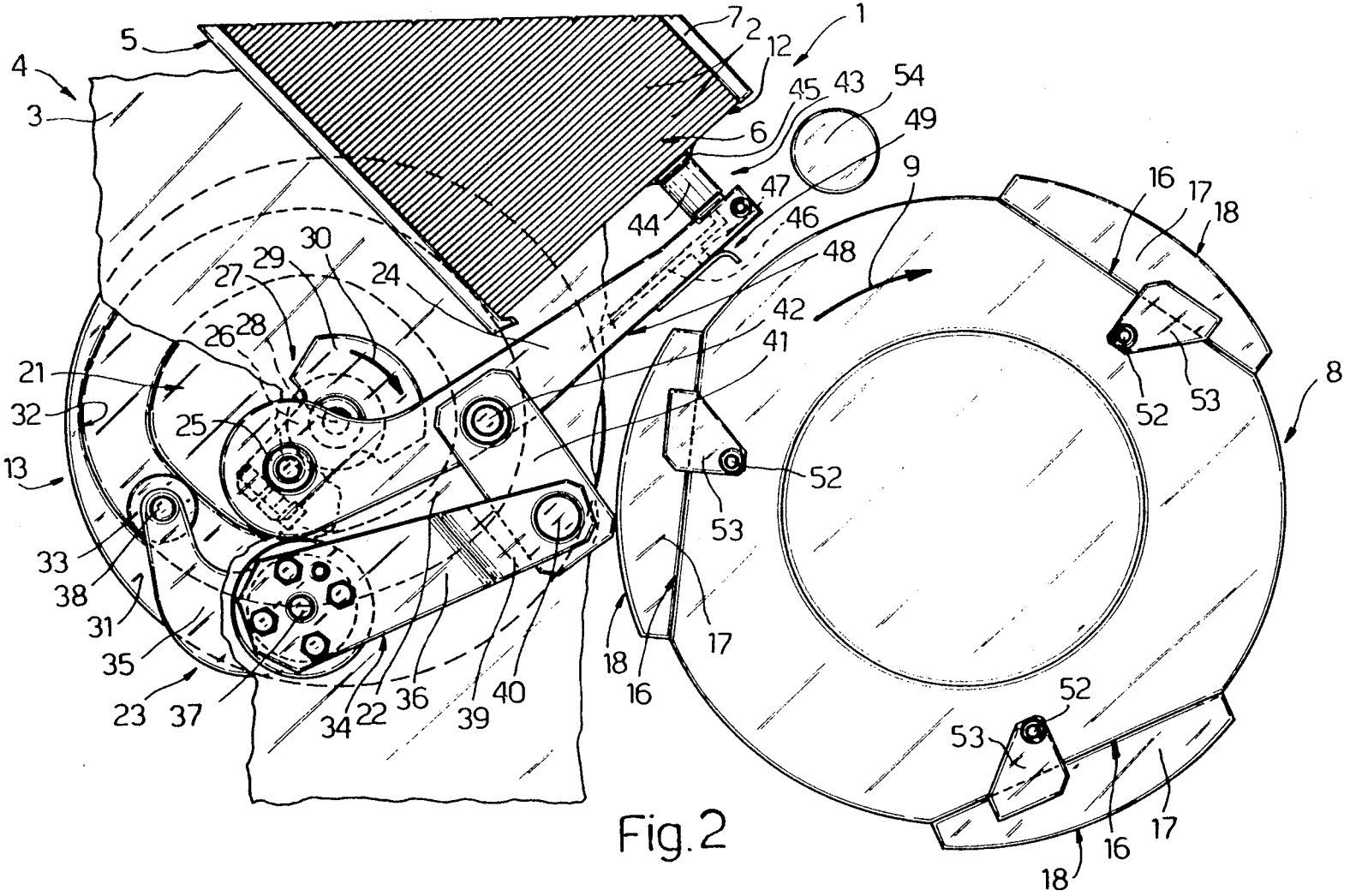
FIG. 2 shows a partially-sectioned side view of the FIG. 1 device.

Number 1 in FIGS. 1 and 2 indicates a device for feeding hard pack blanks 2, and supported on a vertical wall 3 (FIG.2) of a cigarette packing machine indicated as a whole by 4.

Device 1 comprises a feedbox 5 housing a stack 6 of substantially rectangular blanks 2. In the example shown, feedbox 5 extends substantially vertically, and presents a bottom portion 7 having one end facing the outer periphery of a conveyor roller 8 turned at substantially constant surface speed in the direction of arrow 9 by a tubular drive shaft 10 (FIG.1) supported on wall 3 and having a substantially horizontal axis 11 perpendicular to said wall 3.

Said bottom portion 7 of feedbox 5 extends substantially radially in relation to roller 8, and presents a substantially rectangular bottom opening 12 having its longer axis parallel to axis 11. Said blanks 2 are withdrawn successively through opening 12 by transfer unit 13 and fed onto the periphery of roller 8.

As shown in FIG. 1, roller 8 in the example shown consists of four side-by-side discs 14 fitted onto shaft 10 so that each pair of adjacent discs 14 defines an annular groove 15. Each of discs 14 presents three flat faced portions 16 equally spaced about the outer periphery and each defining a supporting surface for a respective block 17 integral with disc 14 and defined outwards by a cylindrical surface 18 coaxial with axis 11 and having a number of suction holes 19 connected in known manner to a suction pump (not shown) through tubular shaft 10.

Each block 17 is aligned, in the direction of axis 11, with respective blocks 17 on the other discs 14, so as to define, about the periphery of roller 8, three supporting strips 20, the length (measured in the direction of axis 11) and width of each of which is substantially equal to those of blank 2.

As shown in FIG. 2, transfer unit 13 comprises a crank mechanism 21 in turn comprising a first connecting-rod-crank drive 22, and a second articulated drive 23 for controlling and guiding drive 22.

With reference to FIG. 1, drive 22 comprises three parallel, side by side levers 24 all fitted onto a tubular shaft 25 parallel to shaft 10, and each designed to engage a respective annular groove 15.

Any number of grooves 15 and respective levers 24, even only one of each, may of course be employed.

With reference to FIG. 2, one end of tubular shaft 25 engages in rotary manner a transverse through hole formed on the end of a first arm 26 of a rocker arm 27 fitted centrally on to a powered shaft 28 parallel to shaft 10, and comprising a second arm opposite arm 26 in relation to shaft 28 and constituting a counterweight 29.

Shaft 28 is turned about its axis in the direction of arrow 30 at the same speed as shaft 10 divided by the number of blocks 17, so that one full turn of shaft 28 is completed in the time taken by roller 8 to move strips 20 forward in the direction of arrow 9, by a distance equal to the center distance between two adjacent strips 20.

Shaft 28 extends in rotary manner through a hole formed in wall 3, and is fitted, on the opposite side of wall 3 to that facing rocker arm 27, with a cam 31 having an annular front groove 32 engaged by a tappet roller 33 controlling drive 23.

Said drive 23 comprises a rocker arm 34 consisting of a first arm 35 and a second arm 36 substantially parallel to and located on opposite sides of wall 3, and connected by a shaft 37 extending in rotary manner through wall 3 and parallel with shaft 10. The free end of arm 35 is fitted with a pin 38 parallel to shaft 10 and supporting in rotary manner roller 33, while a free end portion of arm 36 consists of a fork 39 on which pivots, via a pin 40 parallel to shaft 10, one end of a lever 41, the other end of which pivots on the middle of one of levers 24 via a pin 42 parallel to shaft 10.

Figure 3:
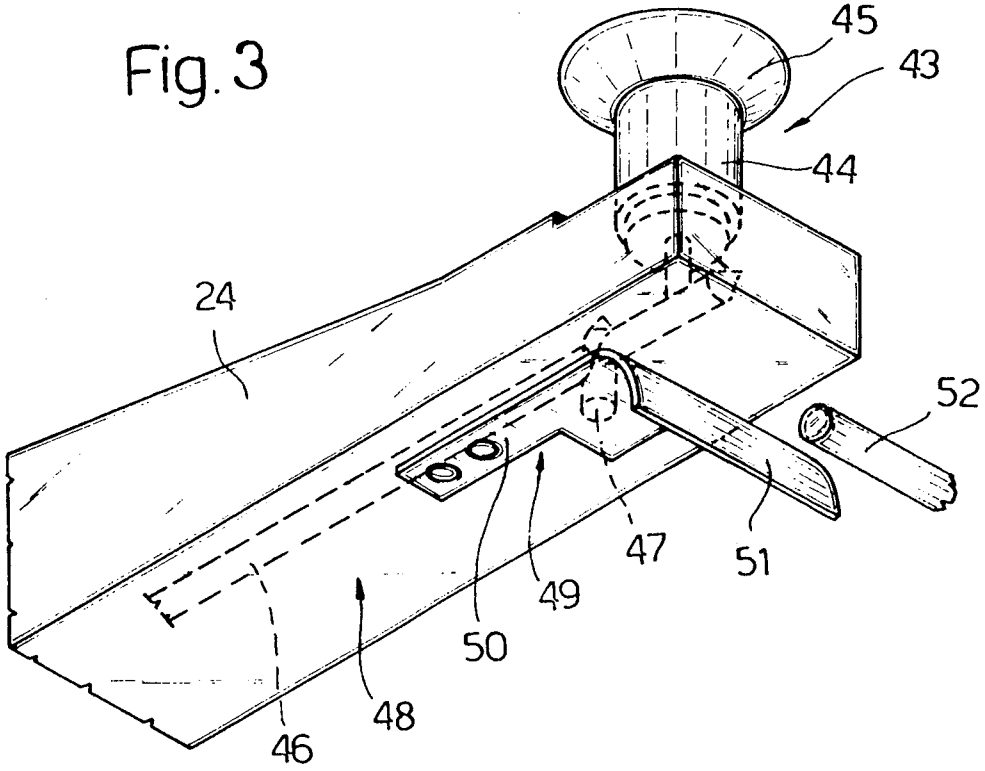
FIG. 3 shows a larger-scale view in perspective of a detail in FIGS. 1 and 2.

As shown, particularly in FIG. 3, each lever 24 is fitted, close to its free end between the bottom of feedbox 5 and the periphery of roller 8, with a suction head 43 comprising a coupling 44 extending towards feedbox 5, parallel to wall 3 and perpendicular to respective lever 24, and having one end connected to lever 24 and the other end fitted with a suction cup 45. Each suction cup 45 communicates with the inside of tubular shaft 25 via respective coupling 44 and a duct 46 formed along respective lever 24. A transverse hole 47, formed in a lateral surface 48 of each lever 24 facing roller 8, provides for external communication of a mid point of respective duct 46, and is normally closed by a valve member 49.

Each valve member 49 consists of a flexible flat blade 50 extending normally in contact with surface 48 of respective lever 24, so as to close respective hole 47 (FIG. 3). At one end, blade 50 is connected integral with surface 48 of respective lever 24, and presents, on the other end facing the free end of lever 24, a curved portion 51 facing the periphery of roller 8 and comprising a portion projecting laterally from respective lever 24. Said projecting portion of curved portion 51 is designed to successively engage pins 52, each supported on a respective bracket 53 on a respective block 17, and each extending crosswise through a lateral portion of the respective groove 15 not engaged by lever 24.

As shown in FIGS. 1 and 2, a roller 54, parallel to roller 8, is supported in idle manner on wall 3 between feedbox 5 and roller 8 and adjacent to heads 43, so as to turn substantially contacting surface 18 of blocks 17 on each strip 20 during rotation of roller 8.

Operation of device 1 will be described with reference to FIGS. 4*a*–4*i*, commencing with FIG. 4*a* wherein suction heads 43, after moving into the withdrawal position underneath the bottom of feedbox 5 for engaging the first blank 2 in stack 6 inside the same, are shown in the process of withdrawing blank 2 through opening 12.

Figure 4A:
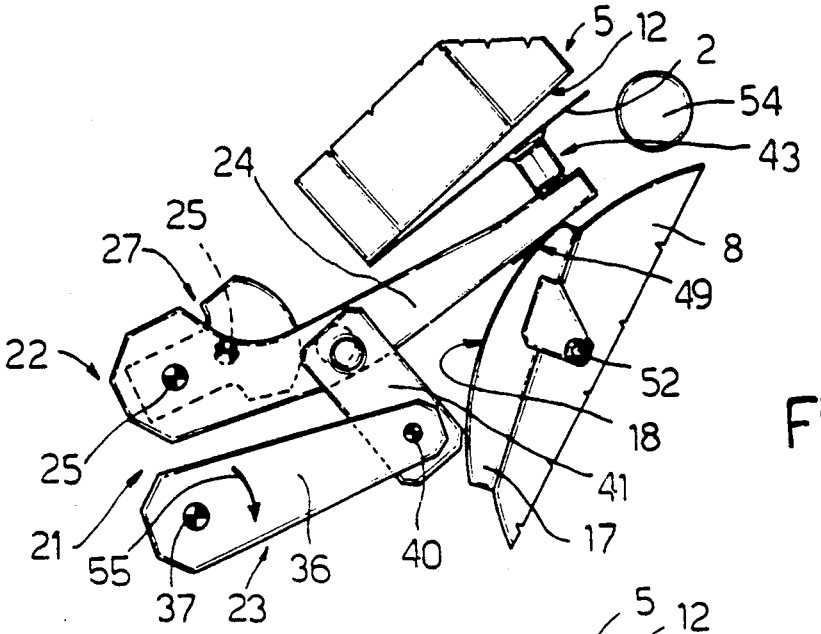
FIGS. 4*a* to 4*a* show schematic views of the FIGS. 1 and 2 device in successive operating positions.
Figure 4B:
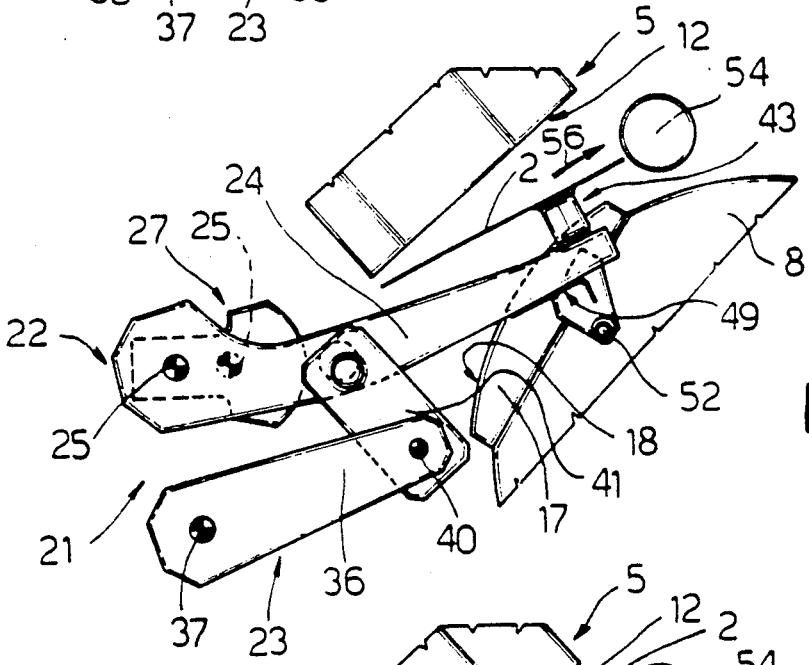

As shown in FIGS. 4*a* and 4*b*, as blank 2 is withdrawn from feedbox 5, levers 24 turn about the rear dead center, while arm 36 of rocker arm 34 turns downwards in the direction of arrow 55 by virtue of cam 31. In other words, levers 24 substantially rotate about a fulcrum consisting of the axis of shaft 25, which is maintained at a substantially constant distance from feedbox 5, while heads 43 travel along a trajectory substantially perpendicular to opening 12.

Figure 4C:
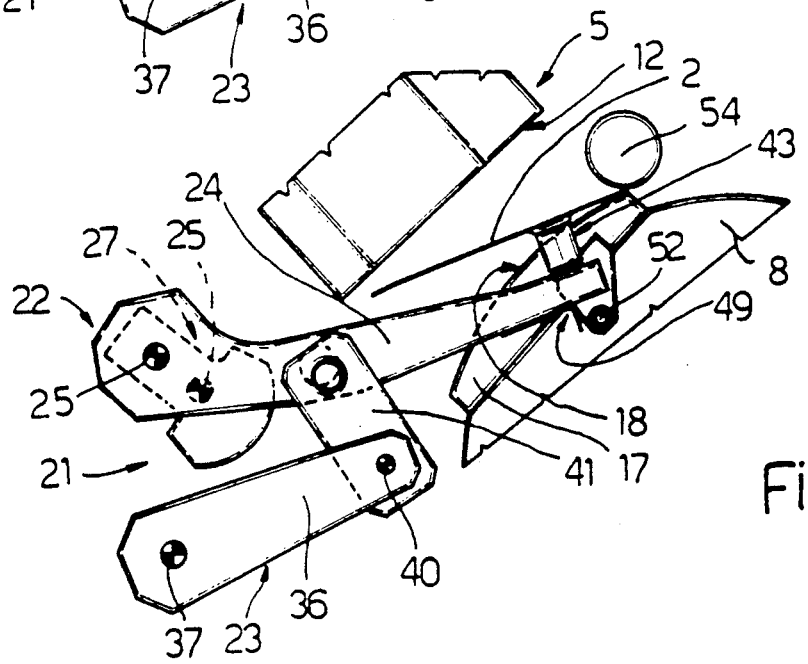

When switching from the FIG. 4*b* to the FIG. 4*c* position, levers 24 move away from the rear dead center so as to move heads 43 in the direction of arrows 56 and 9, while arm 36 of rocker arm 34 is moved by cam 31 in such a manner that, when the front edge of blank 2 contacts the front edge of respective strip 20 by sliding beneath roller 54, the trajectory of heads 43 is substantially a straight line tangent to the periphery of roller 8 at the point of contact between rollers 8 and 54. By appropriately calculating the length of arm 26 of rocker arm 27, heads 43 may be moved forward in the direction of arrow 56 at a speed substantially equal to the surface speed of roller 8, so that blank 2 is deposited on to respective strip 20 at zero speed in relation to strip 20 and in a direction tangent to roller 8.

Figure 4D:
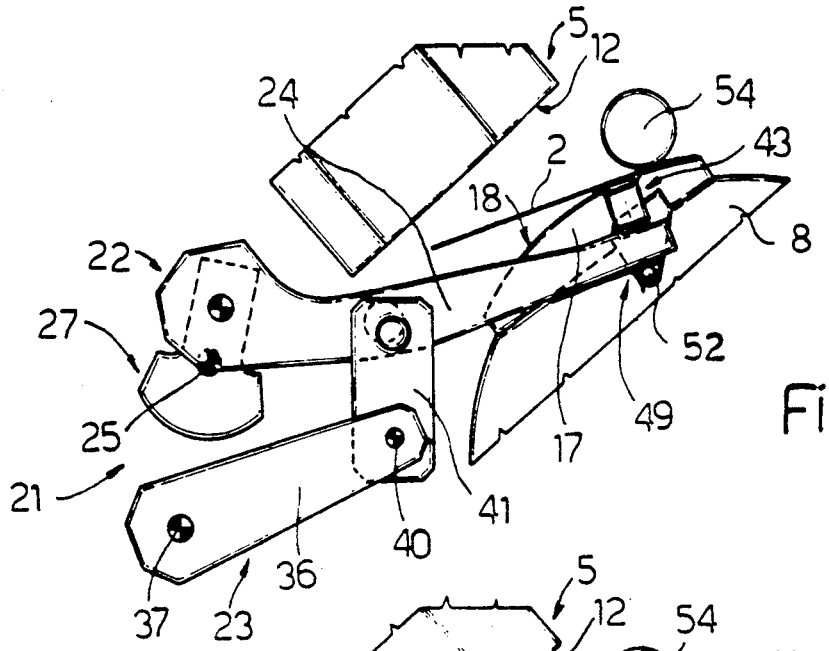
Figure 4E:
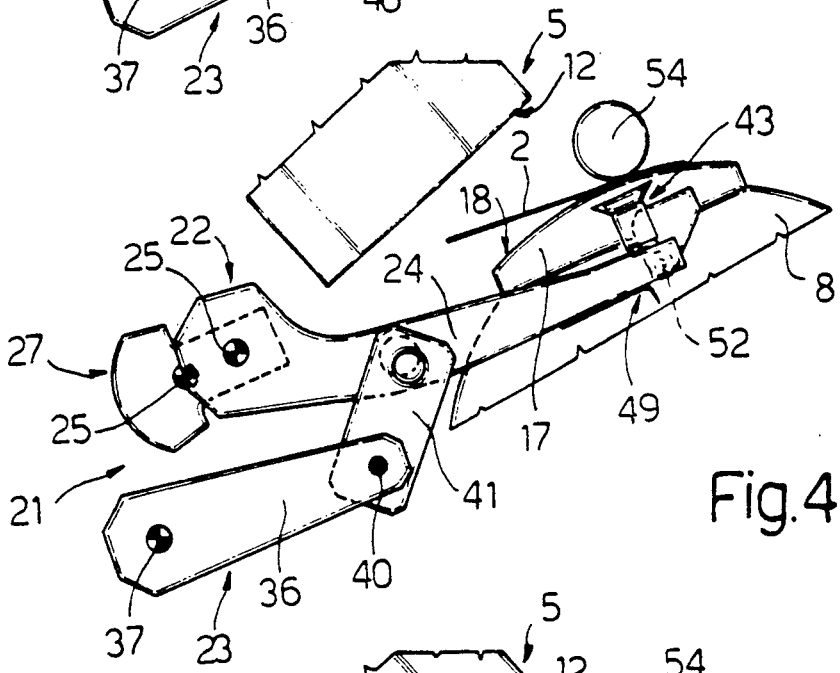
Figure 4F:
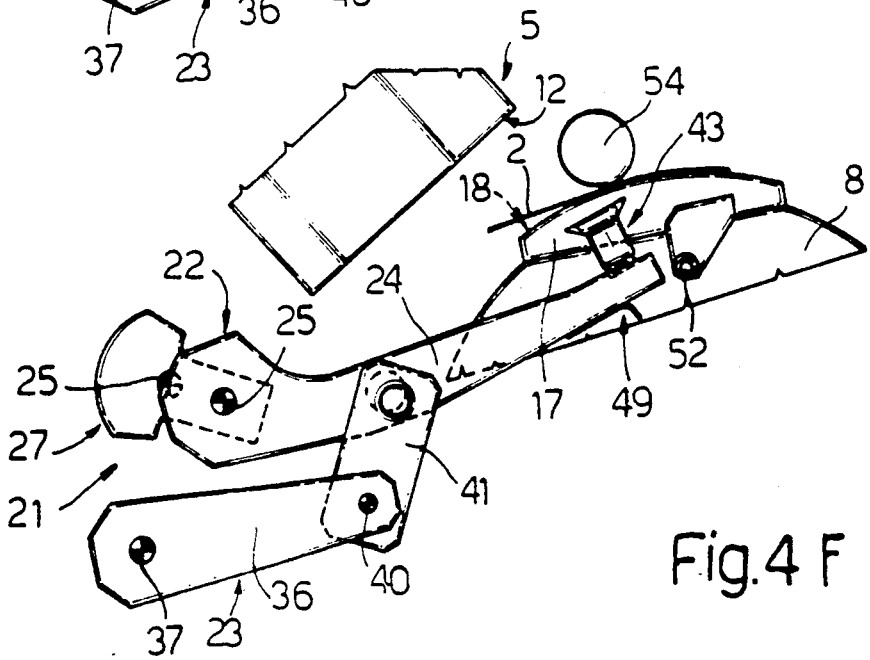
Figure 4G:
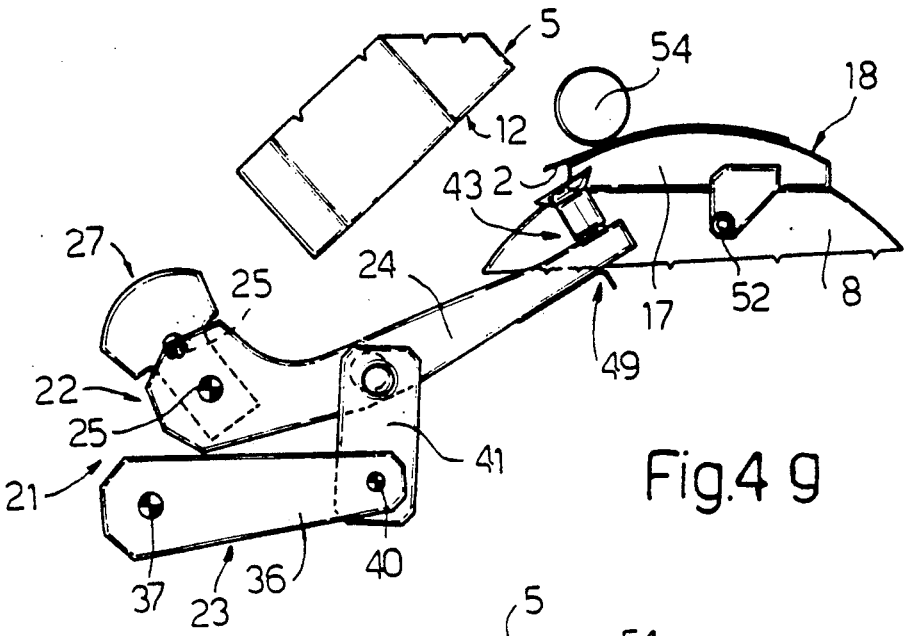
Figure 4H:
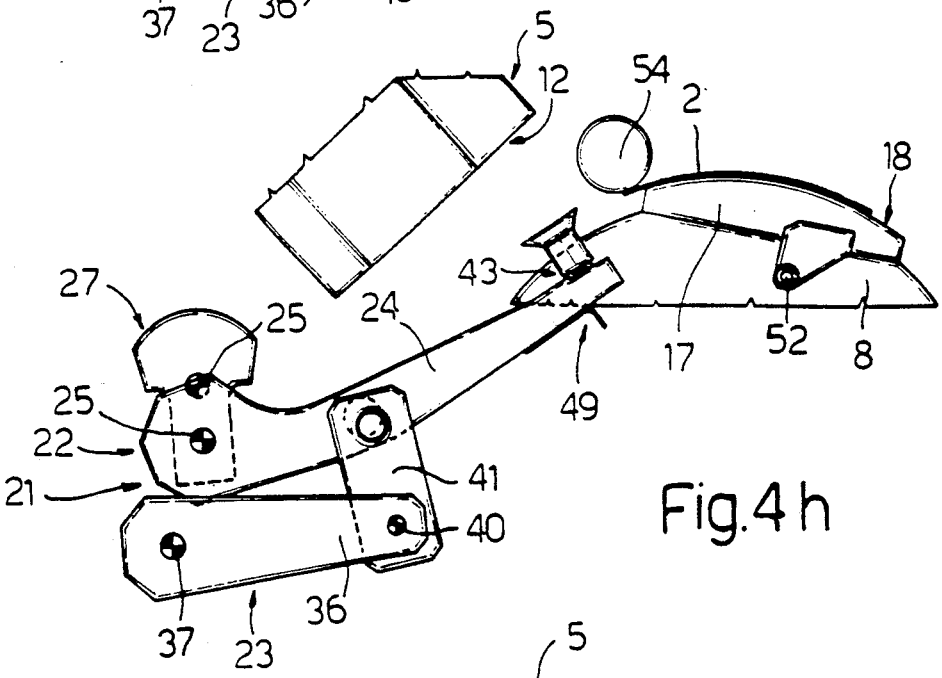
Figure 4I:
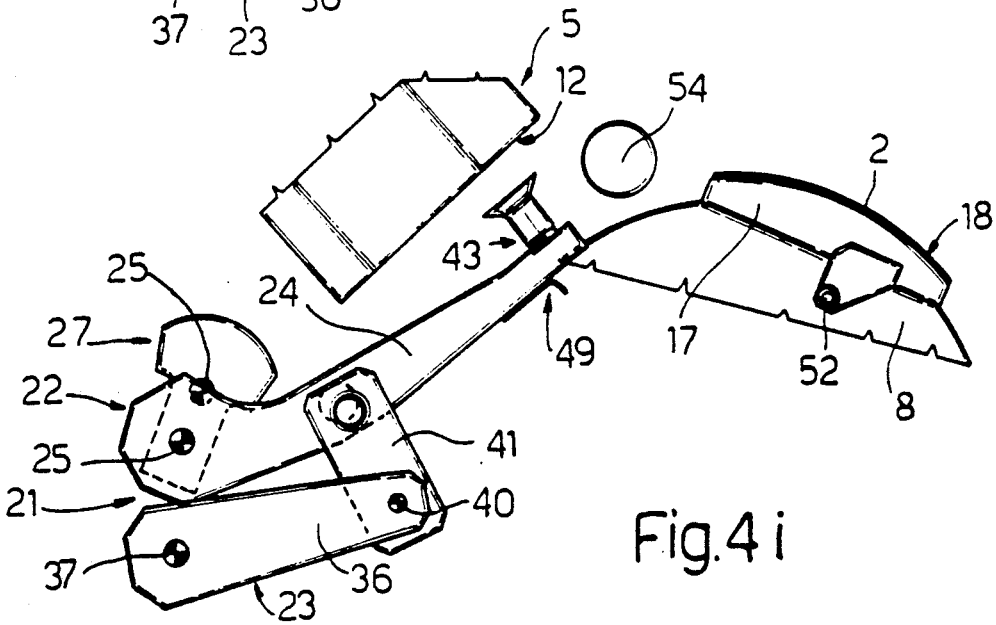

Heads 43 continue moving in the direction of arrow 56 and tangent to the periphery of roller 8 until the unloading position of FIG. 4*d* is reached, at which point curved portion 51 of each blade 50 contacts respective pin 52, which, being housed inside grooves 15, travel parallel to arrow 56 at a slower speed than heads 43. On contacting respective pins 52, blades 50 flex downwards off respective surfaces 48, thus uncovering and enabling external communication of respective holes 47. This eliminates the vacuum inside heads 43 so as to release blank 2, which is pressed by roller 54 onto respective strip 20 and retained by suction on to the same.

It should be pointed out that, if sufficient suction is exerted through holes 19 on blocks 17, roller 54 may even be dispensed with.

Blank 2 is released by heads 43 (FIGS. 4*e* and 4*f*) as levers 24 turn about the front dead center. Consequently, once blank 2 is released, the movement of heads 43 in the direction of arrow 56 is arrested and inverted (FIGS. 4*g* to 4*i*), while cam 31 turns arm 36 first downwards (FIG. 4*f*) to detach heads 43 from blank 2, and then upwards (FIGS. 4*h* and 4*i*) to reset heads 43 in the withdrawal position beneath the bottom of feedbox 5.

At the same time, blank 2, now retained by suction onto respective strip 20, is fed forward by roller 8 in the direction of arrow 9, and transferred continuously in known manner (not shown) onto a further set of rollers 57 (FIG. 1).

Consequently, by virtue of the cyclic trajectory of heads 43 comprising a route portion substantially perpendicular to opening 12 in said withdrawal position, and a further route portion substantially tangent to the outer periphery of roller 8 and covered or followed by heads 43, up to said unloading position, at a speed substantially equal to the surface speed of roller 8, it is possible, by synchronizing rotation of shafts 10 and 28, not only to withdraw blanks 2 correctly folded from feedbox 5, but also to employ a continuous constant speed roller 8, with all the obvious advantages this entails.

We claim:

1. A method of continuously feeding blanks (2), particularly for the formation of hard packs on a cigarette packing machine (4), said method comprising in successively withdrawing said blanks (2) from the bottom opening (12) of a feedbox (5), and in feeding the same onto the outer periphery of a conveyor roller (8) using at least a suction head (43) designed to move between a withdrawal position contacting said blank (2) at said opening (12), and an unloading position wherein said blanks (2) are transferred onto the periphery of said conveyor roller (8); characterized by the fact that said conveyor roller (8) is turned about its axis (11) at constant surface speed; and that said suction head (43) is guided cyclically between said two positions by means of a crank mechanism (21) which moves said suction head (43) along a route having one portion substantially perpendicular to said opening (12), and a further portion substantially tangent to the periphery of said conveyor roller (8) and which further route portion is followed by said suction head (43) at a speed substantially equal to said surface speed.

2. A device for continuously feeding blanks (2), particularly for the formation of hard packs on a cigarette packing machine (4), said device comprising a feedbox (5) for said blanks (2) having a bottom opening (12); a conveyor roller (8); and at least a suction head (43) for successively transferring said blanks (2) from a withdrawal position at said opening (12) to an unloading position on the periphery of said conveyor roller (8); characterized by the fact that it also comprises means (10) for turning said conveyor roller (8) about its axis (11) at constant surface speed; and a crank mechanism (21) for guiding said suction head (43) cyclically between said two positions and along a route having a portion substantially perpendicular to said opening (12), and a further portion substantially tangent to the periphery of said conveyor roller (8), and wherein said further route portions is followed by said suction head (43) at a speed substantially equal to said surface speed.

3. A method of continuously feeding blanks (2), particularly for the formation of hard packs on a cigarette packing machine (4), the method comprising successively withdrawing said blanks (2) from the bottom opening (12) of a feedbox (5), and in feeding the same onto the outer periphery of a conveyor roller (8) using at least a suction head (43) designed to move between a withdrawal position contacting said blank (2) at the bottom opening (12), and an unloading position wherein said blanks (2) are transferred onto the periphery of the conveyor roller (8); characterized by turning the conveyor roller (8) about its axis (11) at constant surface speed; guiding the suction head (43) cyclically between said two positions by means of a crank mechanism (21) which moves the suction head (43) along a route having one route portion substantially perpendicular to the bottom opening (12), and a further route portion substantially tangent to the periphery of the conveyor roller (8) and which further route portion is followed by the suction head (43) at a speed substantially equal to said constant surface speed; removing the suction exerted by the head (43) when the head reaches the end of the second portion of said route; controlling the suction on said suction head (43) by valve means (47,49), and activating the valve means (47,49) for removing the suction by means (52) carried on the conveyor roller (8) and interfering with the valve means (47,49) when the suction head (43) reaches the end of the second portion of the route.

4. A device for continuously feeding blanks (2), particularly for the formation of hard packs on a cigarette packing machine (4), the device comprising a feedbox (5) for the blanks (2) having a bottom opening (12); a conveyor roller (8); and at least one suction head (43) for successively transferring the blanks (2) from a withdrawal position at the bottom opening (12) to an unloading position on the periphery of the conveyor roller (8); characterized by the fact that it also comprises means (10) for turning the conveyor roller (8) about its axis (11) at constant surface speed; a crank mechanism (21) for guiding the suction head (43) cyclically between said two positions and along a route having a first portion substantially perpendicular to the bottom opening (12), and a route second portion substantially tangent to the periphery of the conveyor roller (8), and followed by the suction head (43), at a speed substantially equal to said surface speed; and the suction head (43) comprises normally-closed suction control valve means (47,49); means (52) being provided on the conveyor roller (8) for interfering with and opening the valve means (47,49) when the suction head (43) reaches the end of the route second portion.

5. A device as claimed in claim 4, characterized by the fact that said suction head (43) is connected to a suction duct (46); said valve means (47,49) comprising a hole (47) enabling a mid point on said suction duct (46) to communicate externally, and normally-closed valve member (49) between said hole (47) and the outside atmosphere; said locating means (52) being designed to cooperate with said valve member (49).

6. A device as claimed in claim 5, characterized by the fact that said crank mechanism (21) comprises a lever (24) supporting said suction head (43); said suction duct (46) extending along said lever (24), said hole (47) being formed transversely on said lever (24), and said valve member (49) comprising a flexible blade (50) arranged so as to close said hole (47) and having a curved portion (51) designed to engage said locating means (52).

7. A device as claimed in claim 6, characterized by the fact that said crank mechanism (21) comprises a first connecting-rod-crank drive (22) comprising at least one lever (24) supporting a respective said suction head (43); and a second drive (23) comprising a rocker arm (34), a cam (31) for controlling the position of said rocker arm (34) about a first fixed fulcrum (37), and connecting means (41) located between said rocker arm (34) and the mid point of said lever (24), for controlling, as determined by said cam (31), the position of said lever (24) about a second fulcrum (25) rotating about a fixed shaft (28).

8. A device as claimed in claim 7, characterized by the fact that said conveyor roller (8) presents an external suction surface (18), and an annular groove (15) formed along said suction surface (18) and designed to receive said lever (24) during part of its rotation about said mobile fulcrum (25); said locating means (52) being housed inside said groove (15).

9. A device as claimed in claim 8, characterized by the fact that an idle roller (54) is mounted tangent to said suction surface (18) at said unloading position.

* * * * *